United States Patent [19]

Rudell et al.

[11] Patent Number: 4,697,812

[45] Date of Patent: Oct. 6, 1987

[54] OFF-ROAD SLOT CAR AND TRACK SYSTEM

[75] Inventors: Elliot A. Rudell, 2215 W. 237th St., Torrance, Calif. 90501; Joseph S. Cernansky, Lomita; George T. Foster, Long Beach, both of Calif.

[73] Assignee: Elliot Rudell, Torrance, Calif.

[21] Appl. No.: 806,489

[22] Filed: Dec. 9, 1985

[51] Int. Cl.[4] ..... A63F 9/14; A63H 17/14; A63H 18/12

[52] U.S. Cl. ..... 273/86 B; 238/10 F; 446/446

[58] Field of Search ..... 273/86 B; 238/10 F; 446/444, 445, 446, 455, 457

[56] References Cited

U.S. PATENT DOCUMENTS

| | | | |
|---|---|---|---|
| 2,631,853 | 3/1953 | Haynes et al. | 273/86 B |
| 3,206,122 | 9/1965 | Frisbie | 273/86 B X |
| 3,402,503 | 9/1968 | Glass et al. | 273/86 B X |
| 3,414,194 | 12/1968 | Seitzinger et al. | 273/86 B X |
| 3,422,770 | 1/1969 | Celesia | 273/86 B |
| 4,511,343 | 4/1985 | Goldfarb et al. | 446/457 X |

FOREIGN PATENT DOCUMENTS

| | | | |
|---|---|---|---|
| 2824756 | 12/1979 | Fed. Rep. of Germany | 273/86 B |
| 512304 | 1/1955 | Italy | 273/86 B |

*Primary Examiner*—Anton O. Oechsle

*Attorney, Agent, or Firm*—Plante Strauss Vanderburgh

[57] ABSTRACT

A toy slot car system which simulates off-track racing. The system includes a track, toy vehicles and remote, hand-held controllers to permit each player to control the performance of a preselected vehicle. The track has coextensive, deep slots which have their sidewalls lined with electrical strip conductors, and the toy vehicles have a posts that are received in the deep slots and that carry electrical wipers at their lowermost ends. The surface of the track is rough and uneven with severe undulations which simulate off road conditions and which cause the toy vehicles to be jostled and thrown upwardly, above the track surface during races. Since the slots are quite deep and the electrical strip connectors are quite wide, the cars can bounce over the track and loose all wheel contact with the surface of the track, without loosing electrical continuity with the track, thus creating a realistic simulation of off-track racing.

56 Claims, 6 Drawing Figures

OFF-ROAD SLOT CAR AND TRACK SYSTEM

BACKGROUND OF THE INVENTION

1. Field Of The Invention

This invention relates to a toy slot car system, and in particular, to a toy slot car system that simulates off-road type racing.

2. Brief Statement Of The Prior Art

Track set racing systems have been popular and well known as slot car racing for over 20 years. Typically the systems employ miniature cars, trucks or similar vehicles which run side-by-side, on smooth-surfaced, slotted plastic track. Each vehicle is provided with its own slotted course and has a short pin that extends downwardly into a slot to steer the vehicle along the course. On opposite sides of the slot, metallic strips are positioned slightly above the track surface and these metallic strips conduct electrical power which is tapped by metallic contacts from the underside of the car chassis which ride across the surface of the metallic strips. The typical slot car system as thus described in satisfactory for speed-oriented racing on smooth surfaces. It is totally useless for the simulation of off-road type performance of toy vehicles over rough or irregularly surfaced terrain. The bouncing and jostling of the vehicles over such irregularly surfaced terrain repeatedly separates the vehicle's electrical contacts from the track strips, thereby repeatedly interrupting the power to the vehicles. As a consequence, all slot car race track sets, heretofore, have utilized smooth surfaced rate courses and no system has been devised to simulate off-road racing.

Another toy vehicle and track system has used cars with electrical motors and batteries, which cars are guided by a flexible tubular track. The toy vehicle's wheels ride on the floor surface on either side of flexible tube. This system is not as popular as slot car racing and has many disadvantages including a very limited provision for interaction between the operator and the toy vehicle.

BRIEF STATEMENT OF THE INVENTION

This invention comprises a toy vehicle and track system in which the track has at least one coextensive slot with vertical sidewalls of significant depth, from about 0.5 to about 4 inches, and a toy vehicle having a chassis supporting an electrical motor in driving relationship to at least one rotatable wheel supported on the chassis and positioned to support the toy in rolling contact with the track surface. The vehicle has a downwardly dependent, power supply post which projects a distance from about 0.5 to about 4 inches beneath the wheels and is received within a coextensive slot in the track. The power supply post has wipers that are carried distally on the post and a pair of electrical leads which extend from it respective wipers along said post, to said vehicle and which are in circuit to the electric motor of the vehicle. The running surface of the track is irregular with bumps, ruts, and undulations which are sufficient to bounce and jostle the toy vehicles, causing the vehicles to lose complete wheel contact with the track surface and become stuck in the track, thus providing an extremely high level of realism of simulation of off-road racing. Flat obstructions, such as simulated fallen tree trunks, rocks, etc., can also be molded into the track surface, additionally increasing the realistic simulation of off-track racing. Generally, the track surface is highly irregular with bumps and undulations having inclinations of 5 degrees or greater with abrupt changes from positive to negative inclines.

BRIEF DESCRIPTION OF THE FIGURES

The invention will be described by reference to the FIGURES, of which.

DESCRIPTION OF PREFERRED EMBODIMENTS

Figure 1:
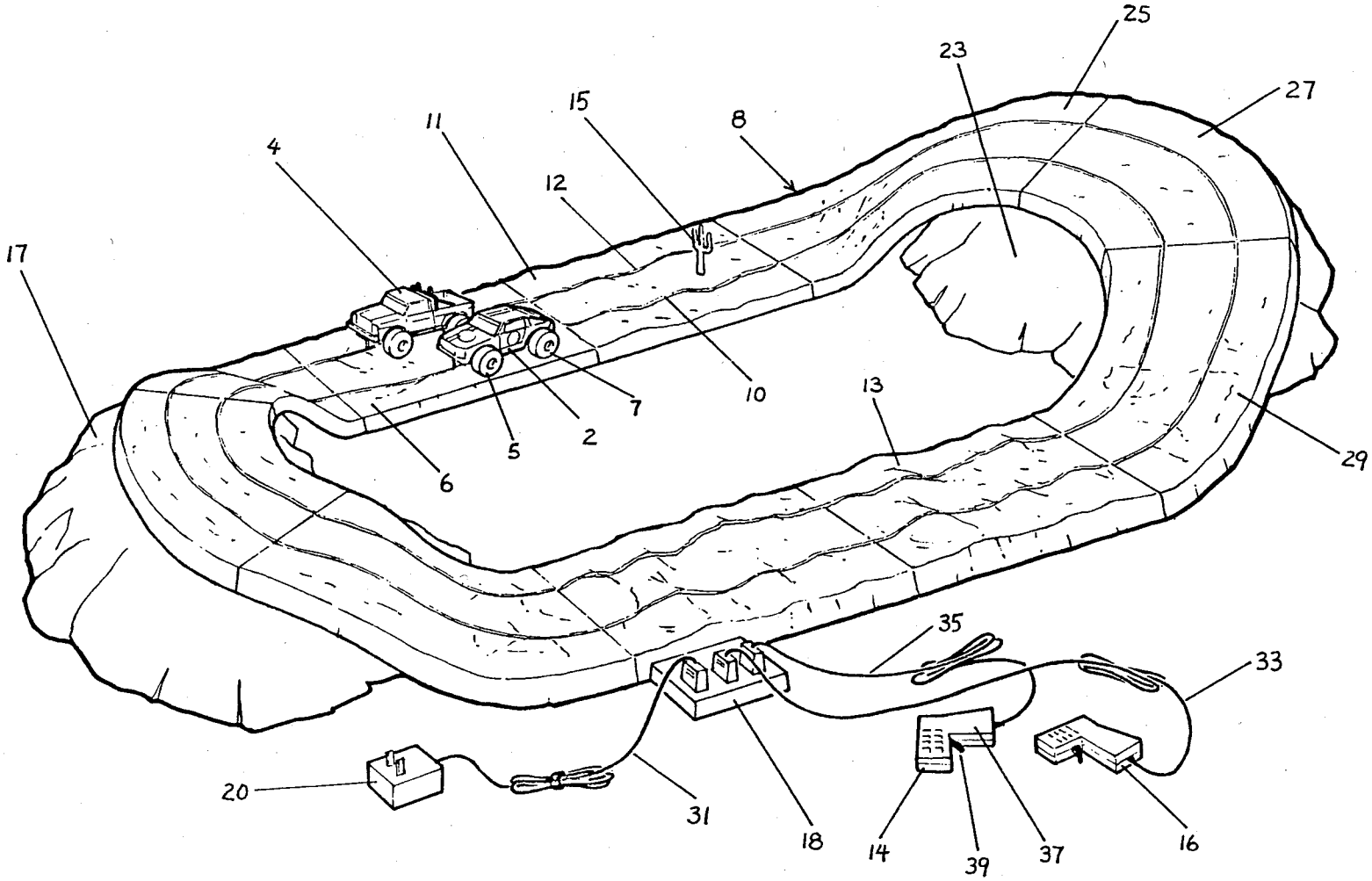
FIG. 1 illustrates a complete playset.

Referring now to FIG. 1, the playset is illustrated with vehicles 2 and 4 positioned on track 6 of the complete race set 8. Each of the two vehicles rides over its respective slot, 10 and 12, and these slots are coextensive the length of the track 6. The particular vehicles which are illustrated are four wheeled vehicles with front wheel assemblies 5 and rear wheel assemblies 7 mounted on respective front and rear axles. Preferably, the vehicles have an external appearance that simulates off road vehicles, e.g., four wheel drive trucks, dune buggies and the like. Other vehicle designs are equally applicable, e.g., two or three wheeled cycles or all terrain vehicles can also be simulated.

The surface of the track 6 is rough with many undulations, such as 11, ruts, and abrupt bumps, such as 13. The vertical undulations 11 are preferably sharply inclined, i.e., with inclined ramps, or tangents to inclined ramps having angles relative to the horizontal plane of the track which are greater than 5 degrees, and preferably greater than 10 degrees. The bumps such as 13 also have similarly sharply inclined positive and negative ramps with sharp transitions between the positive and negative inclines, contributing to jostling the toy vehicle and causing it to separate from track surface. The surface of the track can also have one or more vertical obstructions, such as cactus 15, that can be strategically located to require careful or cautious speed adjustment to maneuver around these obstacles, e.g., to avoid fishtailing of the toy vehicles as they pass the obstacles.

Preferably, the track is provided with at least one or more inclined portions, 17 and 23. As illustrated, each inclined or elevated portion is disposed at an end of the track set in an 180 degree turn-around section formed by mating track segments 25, 27 and 29. As with the straight track segments, previously described, the surfaces of the elevated track segments 25, 27 and 29 are also rough, with undulations, ruts and bumps. As the track segments are modular, they can be assembled in many different configurations, depending on number and shapes of the track segments which are selected.

The track system of the invention receives electrical power in the conventional manner and for this purpose, is provided with a step-down electrical transformer and rectifier to reduce 110–115 volts a.c. electrical power to a suitable value, e.g., from about 4 to about 24 volts, d.c. The transformer can be housed in a single unit with a pair of connector prongs adapted to be inserted in a conventional electrical receptacle outlet. The power supply cord 31 from the transformer 20 is connected into an electrical connector and control box 18. Each of the track slots 10 and 12 has a separate control circuit, which includes the aforementioned power supply, transformer, rectifier, an operator control unit 14 or 16, and continuous strip conductors which are mounted on opposite sides of each slot 10 or 12. The latter are described hereinafter with reference to FIG. 2. Each control unit is in circuit through extension cord 33 or 35 with its respective track slot 10 or 12. Each control unit 14 and 16 has a handle 37 and a trigger 39. Trigger 39 controls the position of the movable contact of a rheostat which is housed in the controller 14 and this rheostat is in circuit with the power supply of controller 18, and its respective slot track 10 or 12, thereby providing a variable resistance in circuit with the respective track slot.

Figure 2:
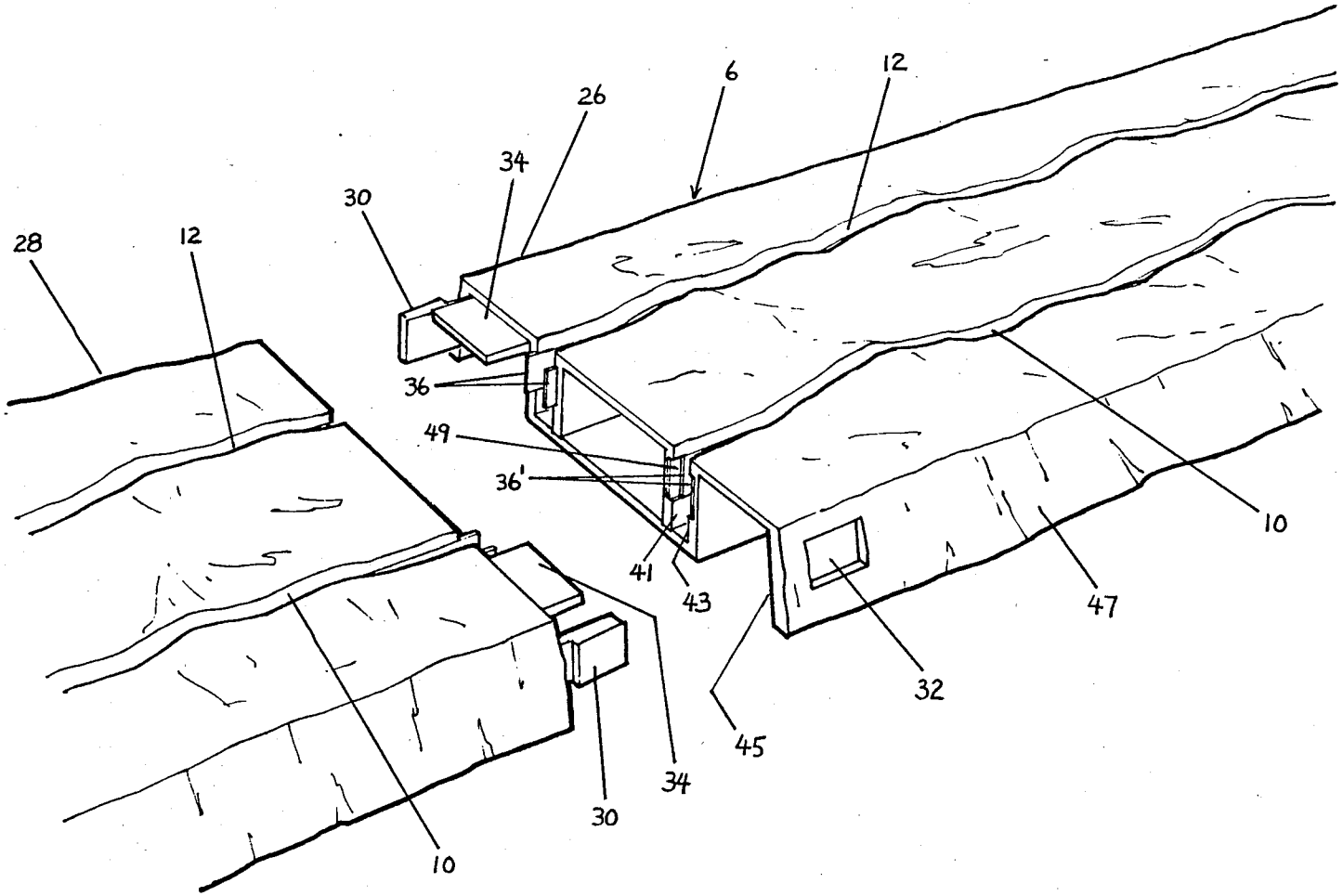
FIG. 2 illustrates connection of adjacent track segments of the playset.

Referring now to FIG. 2, the interconnection and assembly of the separate track segments will now be described. As there illustrated, track segment 6 is provided with mechanical and electrical interconnecting means to the adjacent track segment 28. The track slots 10 and 12 are deep slots with vertical sidewalls 41 and 43 and these slots are coextensive the length of each track segment. Each track segment has an inverted channel such as 45 with an outer side wall 47. At two of its diagonally opposite corners, each track segment has an aperture 32, preferably rectangular in shape, while at the other set of diagonally opposite corners, each track segment supports a pair of interlocking tabs 30 and 34. Tab 30 has a rectangular button projection of the same shape and size as aperture 32 and is positioned on its track segment 28 to snap into aperture 32 when the adjacent sections are mated and joined. The horizontal tab 34 which projects beneath the track surface of track segment 28 is received beneath the mating portion of the track surface of track segment 26 when these adjacent segments are mated.

Each of the two track slots 10 and 12 has coextensive electrical strip connectors 36. These connectors are received in grooves, hereinafter described with reference to FIG. 3, in the vertical sidewalls 41 and 43 of each slot. The strip conductors 36 are in electrical contact with the previously described rectified d.c. power source in controller 18 and the rheostat in its respective hand controller 14 or 16. As illustrated in FIG. 2. these electrical strip connectors 36 also interlock between the adjacent track segments 26 and 28. For this purpose, the connector strips 36 of one track slot such as 12, project slightly past the end of the track segment 26 while the set of track segments 36' of track slot 10 terminate slightly short of the end of track segment 26 leaving recessed pockets 49. A similar construction is employed for track segment 28, thereby providing pockets in its mating portion of track slot 12 that receive the projected end of strip conductors 36 of track slot 12 of track segment 26. Electrical continuity between the adjoining ends of the strip connectors 36 can be ensured by lining pockets 49 with an electrical conducting metal such as copper or brass.

Figure 3:
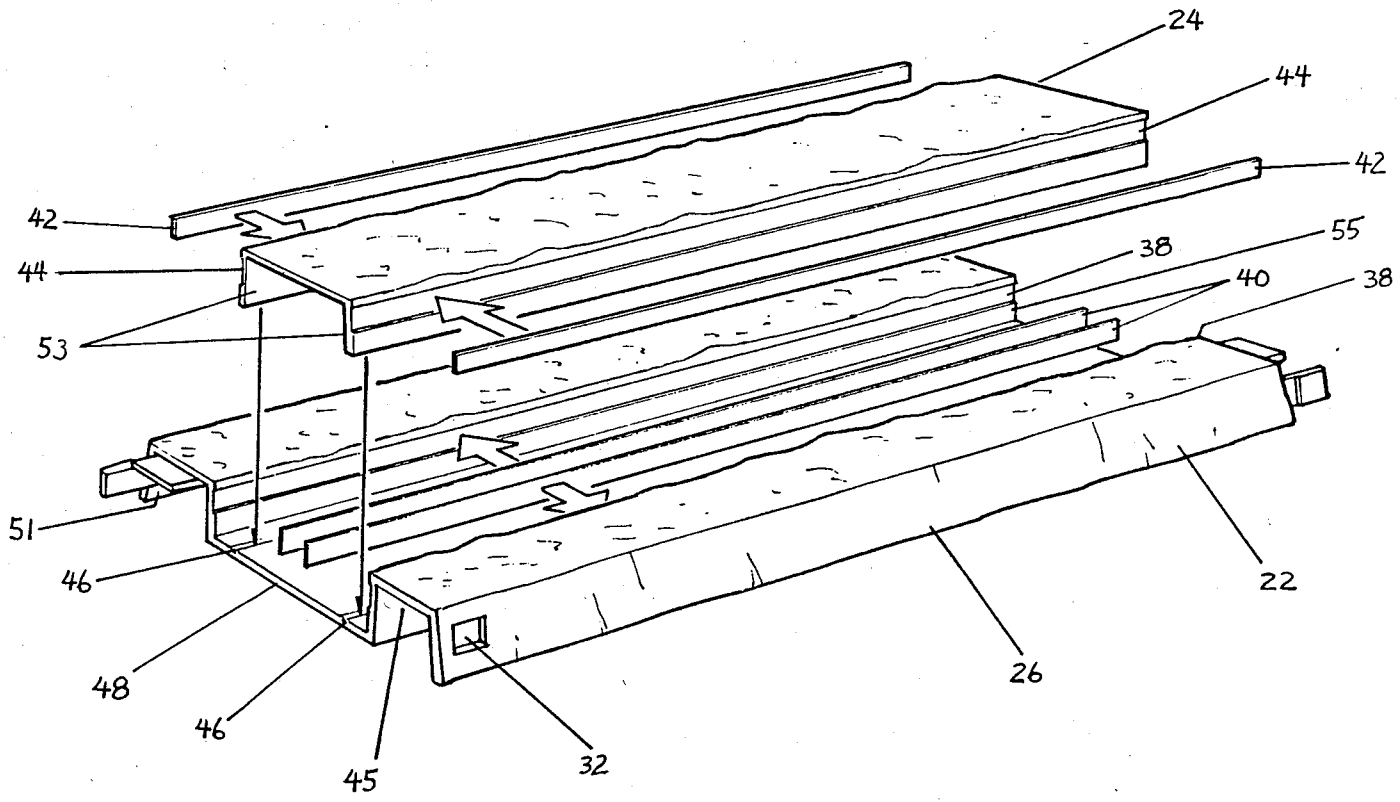
FIG. 3 illustrates the construction of the segments of the track of the playset.

Referring now to FIG. 3, the construction of the track segments will be described in greater detail. As there illustrated, a straight track segment 26 is formed of two major track portions, base 22 and central channel 24. The base 22 has a coextensive, wide channel 48 and opposite, inverted channels 45 and 51. The undersurface of central channel 48 is flat and smooth to provide a support for the track segment on a suitable floor or table. The upper surfaces of the laterally opposite, inverted channels 45 and 51 provide the outer, longitudinal portions of the top surface of the track and have the aforementioned rough and undulating surface with sharp irregularities and bumps. The coextensive, central channel 24 is also inverted in the assembly and the lower edges 53 of its opposite sidewalls are received in coextensive, longitudinal grooves 46 in the top surface of central channel 48. Each of the vertical walls 53 of top channel 24 has a longitudinal, coextensive groove 44 on its outer surface and this groove extends a substantial portion of the width of this vertical wall 53, e.g., from about one-third to about three-fourths of its width. Each groove 44 receives an electrical strip conductor 42 which has a width corresponding to the width of the receiving groove 44. The inside surface of the vertical walls 55 of central channel 48 also have a coextensive, longitudinal groove 38 and each of the grooves 38 receives electrical strip conductors 40 which are of the same shape and dimensions previously described for strip conductors 42.

The track portions 22 and 24 are preferably formed of plastic by any convenient manufacturing method, preferably by injecting molding, as it provides for maximum speed of manufacture, and control of the irregularities and detail required for proper connection and alignment of the track segments. The two track portions 22 and 24 can be formed of any suitable plastic, preferably of high impact polystyrene or an equivalent plastic material. The two track sections 22 and 24 are joined, as previously mentioned by seating the bottom edges of walls 53 in longitudinal grooves of 46 and this assembly is permanently secured by suitable means, e.g., solvent welding, heat staking, snap fitting, etc. The electrical strip conductors 40 and 42 are formed of suitable electrical conducting metals such as copper, brass, etc. These strips are permanently secured in the receiving grooves 44 and 38 by suitable techniques such as rivets, screw fasteners, contact cement or solvent bonding, etc.

Figure 4:
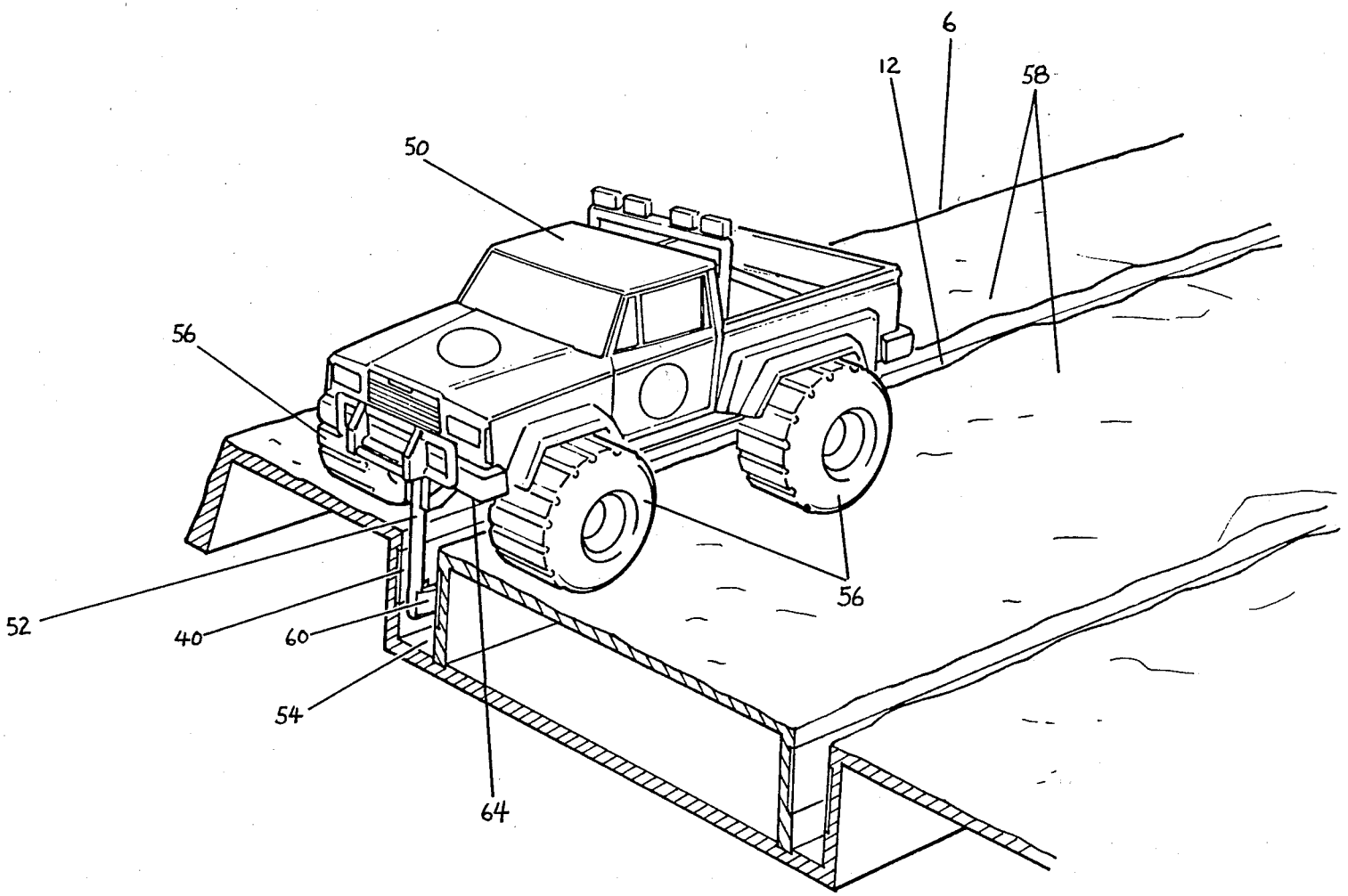
FIG. 4 illustrates the operable position of a toy vehicle on the track.

Referring now to FIG. 4, there is illustrated a vehicle 50 positioned in its operable location on the track 6 of the invention. The particular vehicle illustrated is a four wheel vehicle with front and rear sets of tires 56, each set being mounted on front and rear axles. The chassis 64 of vehicle 50 supports a downwardly dependent slot post 52 that projects into the track slot 12. The slot post 52 distally supports a pair of wiper members such as 60 which are resiliently biased in an outwardly lateral direction to be in bearing contact with the electrical strip conductors such as 40 which line the vertical walls of the track slot 54. As these conductor strips 40 and 38 comprise opposite conductors buses of the d.c. power supply, the slot post 52 thus provides physical orientation of the toy vehicle 50 on the track and provides the electrical connection between the power supply furnished by the conductor strips of opposite polarity.

Figure 5:
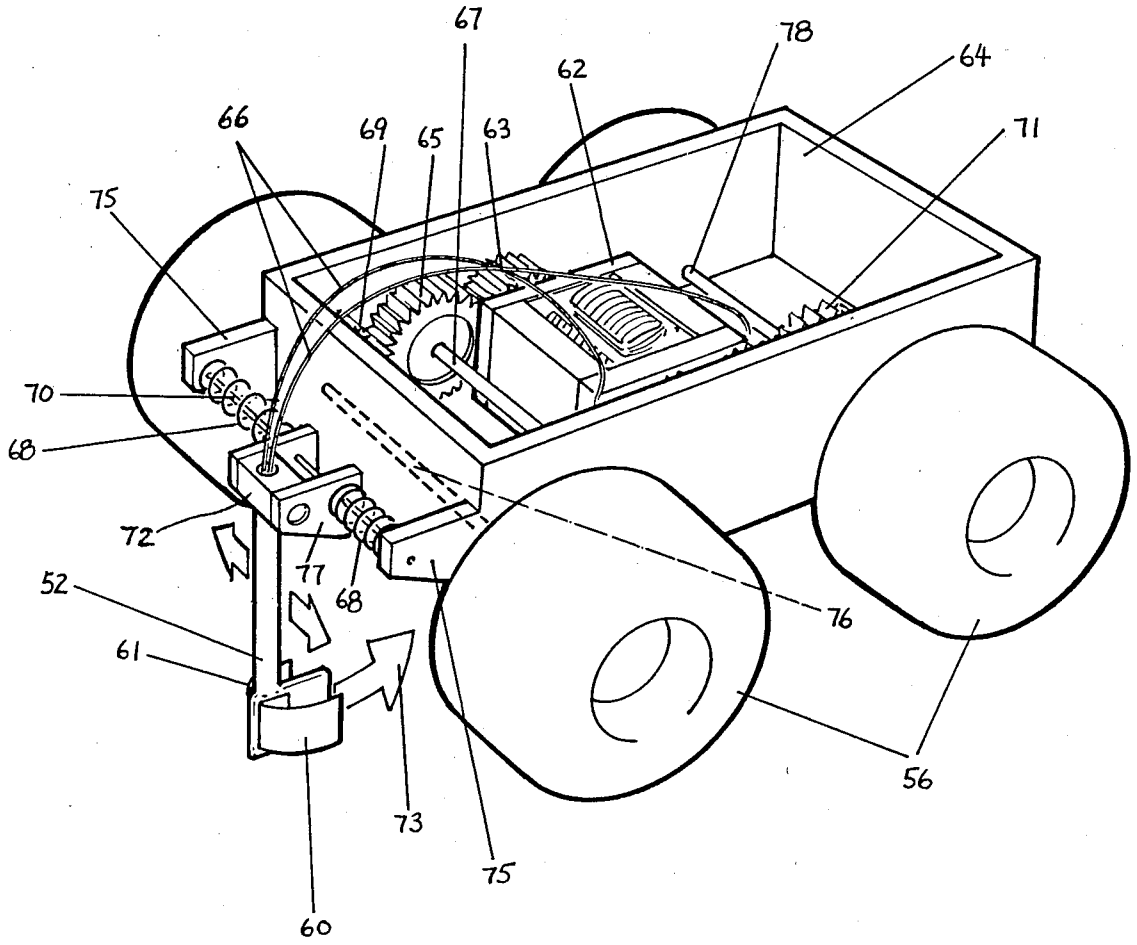
FIG. 5 illustrates the elements of the vehicle.

Referring now to FIG. 5, the construction of the toy vehicles will be described. Each toy vehicle has a chassis 64 with a front axle 76 and rear axle 78 that support the pair of forward wheels and pair of rear wheels 56. The chassis receives an electrical d.c. drive motor 62 having an output gear 63 that is connected through a suitable gear train, e.g., gear 65 that is mounted on shelf 67 and that is connected to a driven gear 69 that is fixedly mounted on shaft 76, thereby permitting motor 62 to be in driving relationship to the forward pair of wheels 56. Preferably, a similar arrangement is provided through a gear train, generally indicated at 71 for driving the rear axle 78, thereby providing four wheel capabilities. The chassis 64 also supports the slot post 52. For this purpose, a pair of mounting lugs 75 are located at opposite sides of the forward end of the chassis and these lugs support a mounting rod 70. The slot post 52 is downwardly dependent from a mounting block 72 which is fixedly secured between opposite side flanges 77. Flanges 77 have aligned apertures to permit the assembly to be received on rod 70 thereby providing for pivotal mounting of slot post 52, permitting it to be swung in the direction indicated by arrowhead 73. If desired, the slot post can be centered on the vehicle by a pair of compression springs 68, one at each side of the block 72. One or both of springs 68 constitute spring means biasing post 52 into its vertical position. As the post 52 is pivotally supported in the assembly, its weight will aid in maintaining it in a vertical position. As previously mentioned, the slot post 52 distally supports resilient wipers 60 and 61 which are secured at their forward edges to the slot post 52 and which flare outwardly in a lateral direction, as illustrated.

Figure 6:
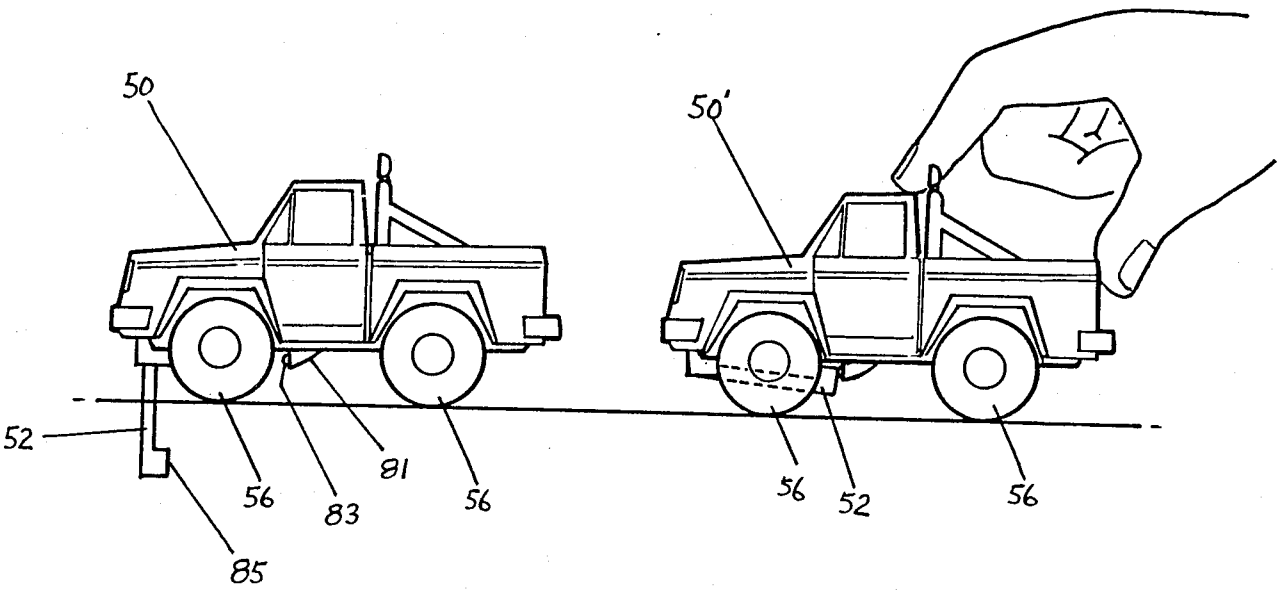
FIG. 6 illustrates an optional retractable power post.

Referring now to FIG. 6, each toy vehicle 50, as previously described, has the slot post 52 downwardly dependent therefrom. In a preferred construction, the slot post 52 is pivotally mounted so that it can be swung up and under the vehicle in the manner illustrated for the vehicle 50' at the right of the illustration. Preferably, detent means are provided to restrain the slot post 52 in this position, such as detent supporting bracket 81 with a spring biased detent 83 which engages against the trailing edge 85 of the tab on the slot post 52. In this manner, the toy vehicles 50 can be deployed on a flat, unslotted track surface. If desired, provision can be made in the chassis of the vehicle to receive a suitable battery pack permitting operation of the vehicle 50 independent of the track 6.

The invention provides a very realistic simulation of off-road racing and permits operators to acquire a high degree of competitive skill. The bumps, ruts and undulations in the track surface are sufficiently severe that the vehicles frequently become "air borne" and control of the vehicles' speeds is required to avoid completely dislodging the slot posts of the vehicles from the track slots. Since the vehicles do not carry batteries they can be designed with minimal mass, thus enhancing this action. When the driving wheels break from the track surface, they accelerate in rotational speed, since the vehicle continues to receive power from the slot post. This contributes to a realistic "peel out" when the vehicle falls back onto the track surface. The level of competitive skill is further heightened by the presence of one or more obstacles such as miniature trees, buildings, etc., along the track which are placed sufficiently close to the track slots as to provide minimal clearance for the vehicles, thereby requiring the operators to control the speeds of their vehicles carefully to maneuver past the obstacles.

The invention preferably provides a continuity of power supply to the vehicles throughout most of their operation. This is achieved by providing a sufficient vertical width to either or both of the pairs of wipers or pairs of conductor strips such that the electrical contact between these members is maintained throughout most of all of the vehicles' transit over the track, including even those moments when the vehicles are airborne. As an example, narrow width wipers could be used with wide conductor strips, or vice versa. Also if desired, both could be wide.

The invention has been described with reference to the illustrated and presently preferred embodiment. It is not intended that this disclosure of the presently preferred embodiment be unduly restricting. Instead, it is intended that the invention be defined by the means, and their obvious equivalents, set forth in the following claims:

What is claimed is:

1. An electrically powered toy comprising:

(a) a toy vehicle chassis;

(b) an electric motor carried on said chassis;

(c) rotatable wheel means supported on said chassis and positioned thereon to support said toy in rolling contact with a track surface;

(d) power train means mechanically connecting said at least one wheel of said rotatable wheel means to said electric motor;

(e) a power supply post supported on said chassis for lateral side-to-side displacement thereon and projecting vertically beneath said wheel means by a distance from 0.5 to about 4 inches; '(f) first and second power wipers carried distally by said power supply post; and (g) at least a pair of electrical leads, one each extending from a respective wiper along said post and in circuit to said electrical motor.

2. The toy of claim 1 including a pair of front wheels and a pair of rear wheels mounted on front and rear shaft means, respectively.

3. The toy of claim 2 wherein said front wheels are mechanically connected by gear train means to said electric motor.

4. The toy of claim 2 wherein said rear wheels are mechanically connected by gear train means to said electric motor.

5. The toy of claim 2 wherein said front and said rear wheels are mechanically connected by gear train means to said electric motor.

6. The toy of claim 1 wherein said electric motor is a direct current motor operable at a voltage from 2 to about 24 volts.

7. The toy of claim 1 wherein said post is supported from the front end of said chassis.

8. The toy of claim 6 wherein said post is pivotally supported on said chassis, permitting it to be swung upwardly to an upwardly folded position beneath said chassis.

9. The toy of claim 8 including spring means biasing said post into a vertical position.

10. The toy of claim 8 including post retraction means including a spring biased detent operative to engage and restrain said post in an upwardly folded position.

11. The toy of claim 8 including a post mounting block fixedly secured to said chassis and pivotally supporting said post.

12. The toy of claim 11 wherein said chassis has first and second laterally-spaced-apart lugs, with a pin extending therebetween and said post mounting block is pivotally received over said pin.

13. The toy of claim 12 wherein said post mounting block is slidably received on said pin to permit its displacement side-to-side on the chassis.

14. The toy of claim 13 including spring means to bias said block centrally on said vehicle.

15. The toy of claim 14 wherein said spring means comprise compression springs retained between opposite sides of said block and respective lugs, thereby centering said block between said lugs.

16. The toy of claim 1 wherein said first and second power wipers are metal bands carried on opposite sides of said post.

17. The toy of claim 16 wherein said first and second power wipers are resilient metal spring bands which are secured to said post and are biased to flare outwardly therefrom.

18. A toy track for motorized toy vehicles comprising:

(a) a running surface for said vehicles having a rough unpaved surface with bumps and undulations having inclinations of 5 degrees or greater and with abrupt changes from positive to negative inclines, thereby simulating an off-road environment;

(b) at least one slot in said running surface, conextensive therewith;

(c) opposite sides coextensive the length of said slot and extending beneath said slot a distance from 0.5 to about 4 inches;

(d) first and second electric conductor strips, one each positioned on a respective lateral side of each said slot.

19. The toy track of claim 18 formed of separate interchangeable, and interlocked track segments, each segment having distal interlocking means for connecting said segments, end-to-end, and electrical interconnecting means bridging between the first strip conductors, and between second strip conductors, of adjacent track semments.

20. The toy track of claim 19 wherein said interlocking means comprise spring biased tabs projecting from one segment and mating apertures of the next, adjacent segment.

21. The toy track of claim 18 wherein said track has at least two coextensive slots.

22. A toy track for motorized toy vehicles comprising:

(a) a running surface for said toy vehicles;

(b) at least one slot in said running surface, coextensive therewith;

(c) opposite sides coextensive the length of said slot and extending beneath said slot a distance from 0.5 to about 4 inches;

(d) first and second electric conductor strips, one each positioned on a respective lateral side of each said slot;

(e) a center channel centrally located on said track, and including a coextensive center channel member received therein.

23. The toy track of claim 22 wherein said center channel member has sidewalls having the same curvature and contour as the sidewalls of said center channel and a width less than said center channel to space its sidewalls apart from the sidewalls of said center channel, thereby defining said grooves.

24. The toy track of claim 23 wherein said track surface is rough and uneven.

25. The toy track of claim 24 wherein said track surface is undulated.

26. The toy track of claim 25 wherein said undulations are at angles greater than 5° to said track surface.

27. The toy track of claim 26 including inclined up and down ramp surface portions to said track.

28. A toy electric track racing set comprising:

(a) at least one toy vehicle with an electric motor mounted thereon, and an electric power supply post downwardly dependent from the bottom of said vehicle;

(b) a track circuit supporting said vehicle and having a rough, unpaved surface simulating an off-road environment and at least one, coextensive, deep slot which receives said power supply post;

(c) a set of electrically conducting strips coextensive with, and lining the opposite sidewalls of said deep slot, and a set of first and second wipers mounted on opposite sides of said power supply post and resiliently contacting said conducting strips, with at least one of said sets of strips and wipers having a width sufficient to retain said resilient contact while permitting said vehicle to become airborne; and (d) a power supply transformer, and a rheostat controller for said vehicle, in circuit with said electric power supply post to power, and control the speed, of said vehicle.

29. The racing set of claim 28 wherein said track has at leaset two of said coextensive slots, with one of said toy vehicles over each of said slots.

30. The racing set of claim 29 wherein each said slot has sidewalls which are lined with respective coextensive electrically conducting strips and including first and second wipers mounted on said power supply post which resiliently contact said conducting strips.

31. The racing set of claim 30 wherein each said slot has a depth from 0.5 to 4 inches.

32. The racing set of claim 28 wherein said track is formed of modular, interchangeable, and interlocked segments.

33. The racing set of claim 32 wherein said track segments have distal interlocking means for connecting said segments, end-to-end, and electrical interconnecting means bridging between the continuous conducing strips of adjacent track segments.

34. The racing set of claim 33 wherein said interlocking means comprise spring biased tabs projecting from one segment and mating apertures of the next, adjacent segment.

35. The racing set of claim 33 wherein each said track segment has a central channel, and including a coextensive center channel member received therein.

36. The racing set of claim 35 wherein said center channel member has sidewalls having the same curvature and contour as the sidewalls of said center channel and a width less than said center channel to provide said sidewalls spaced apart from the sidewalls of said center channel, thereby defining said grooves.

37. The racing set of claim 28 wherein said track surface is rough and uneven.

38. The racing set of claim 37 wherein said track surface is undulated.

39. The racing set of claim 38 wherein said undulations are at angles greater than 5° to said track surface.

40. The racing set of claim 28 including inclined up and down ramp surface portions to said track.

41. The racing set of claim 29 wherein each said toy vehicle has a pair of front wheels and a pair of rear wheels mounted on front and rear shafts, respectively.

42. The racing set of claim 41 wherein said front wheels of each said vehicle are mechanically connected by gear train means to its respective electric motor.

43. The racing set of claim 41 wherein said rear wheels of each vehicle are mechanically connected by gear train means to its respective electric motor.

44. The racing set of claim 41 wherein said front and said rear wheels of said vehicle are mechanically connected by gear train means to its respective electric motor.

45. The racing set of claim 29 wherein said electric motor of said toy vehicle is a direct current motor operable at a voltage from 2 to about 24 volts.

46. The racing set of claim 29 wherein said post of each said vehicle is supported from the front end of the chassis of said vehicle.

47. The racing set of claim 46 wherein said each said post is pivotally supported on said chassis of each said vehicle, permitting it to be swung upwardly to an upwardly folded position beneath said chassis, and above the track surface.

48. The racing set of claim 47 wherein each said vehicle includes spring means biasing said its post into a vertical position.

49. The racing set of claim 46 wherein each said vehicle includes post retraction means comprising a spring biased detent operative to engage and restrain its post in an upwardly folded position.

50. The racing set of claim 46 wherein each said vehicle includes a post mounting block fixedly secured to said chassis and pivotally supporting its post.

51. The racing set of claim 50 wherein each said toy vehicle has a chassis which supports first and second laterally-spaced-apart lugs, with a pin extending therebetween and with its respective post mounting block pivotally received over said pin.

52. The racing set of claim 51 wherein each said vehicle has its post mounting block slidably received on said pin to permit its displacement side-to-side on its chassis.

53. The racing set of claim 52 wherein each said vehicle includes spring means to bias its block to a preselected position on said pin.

54. The racing set of claim 53 wherein said spring means comprises compression springs retained between opposite sides of said block and respective lugs, thereby centering said block between said lugs.

55. The racing set of claim 28 wherein each said vehicle includes first and second power wipers carried on opposite sides of its respective post.

56. The racing set of claim 55 wherein said first and second power wipers are resilient metal spring bands which are secured to said post and are biased to flare outwardly therefrom.

* * * * *